United States Patent [19]

Fadner

[11] Patent Number: 4,977,830

[45] Date of Patent: Dec. 18, 1990

[54] HYDROPHOBIC AND OLEOPHILIC MICROPOROUS INKING ROLLERS

[75] Inventor: Thomas A. Fadner, La Grange, Ill.

[73] Assignee: Rockwell International Corporation, Pittsburgh, Pa.

[21] Appl. No.: 343,556

[22] Filed: Apr. 27, 1989

[51] Int. Cl.[5] ..... B41F 31/00

[52] U.S. Cl. ..... 101/350; 29/132; 29/895.32; 427/333; 427/344

[58] Field of Search ..... 101/147, 148, 348, 349, 101/350; 29/132, 148.4 D, 121.8; 427/333, 344, 230

[56] References Cited

U.S. PATENT DOCUMENTS 4,179,537 12/1979 Rykowski ..... 427/333 X 4,301,730 11/1981 Heurich et al. ..... 101/483 X 4,566,938 1/1986 Jenkins ..... 101/348 X

FOREIGN PATENT DOCUMENTS 56855 4/1983 Japan ..... 101/348

44394 3/1985 Japan ..... 101/348

*Primary Examiner*—Clifford D. Crowder

[57] ABSTRACT

An inking roller or ink metering roller comprised of a base roller, a substantially continuous hard and wear-resistant microporous ceramic coated layer bonded to the base roller and an interdiffused and immobilized oleophilic and hydrophobic essentially organic polymeric based material affixed to the surfaces and interstices of the microporous layer. The material may be a titanate coupling agent or a silane coupling agent.

16 Claims, 2 Drawing Sheets

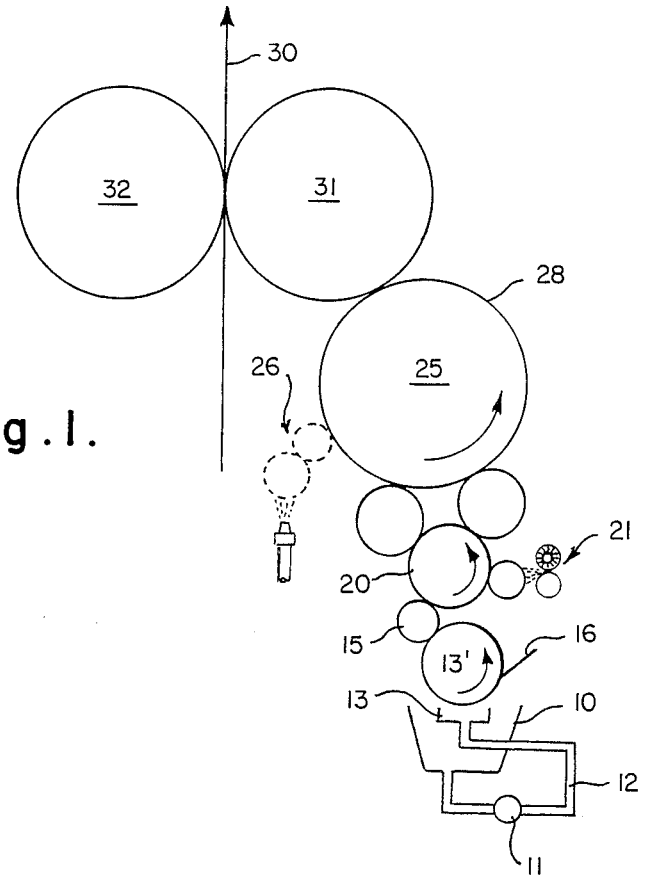
Fig. 1.
Fig. 2.
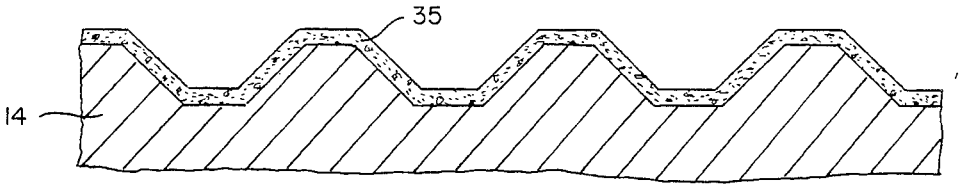
Fig. 3.
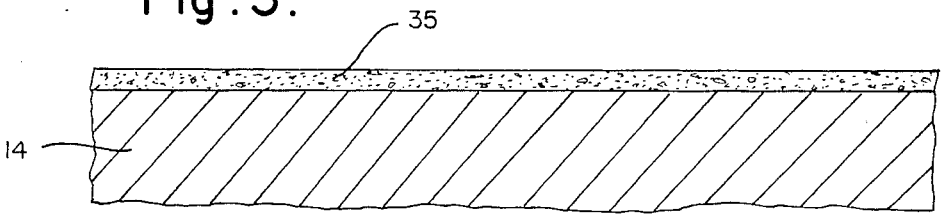

HYDROPHOBIC AND OLEOPHILIC MICROPOROUS INKING ROLLERS

BACKGROUND OF THE INVENTION

In the practice of keyless inking for lithographic printing whereby ink is metered into the printed system by means of a metering roller and a cooperating scraping blade, Fadner in U.S. Pat. No. 4,601,242, Fadner and Hycner in U.S. Pat. No. 4,537,127 and Fadner in U.S. Pat. No. 4,603,634 have disclosed advantageous method and means wherein the surface of an ink metering roller will possess the dual property of being both hydrophobic and oleophilic, that is water-repelling and oil attracting. This dual property can be present whether the lithographic ink metering roller surface is formed with ink retaining dimensioned cells or is formed with a surface possessing irregularly spaced cavities capable of retaining ink. In practicing keyless inking the presence of oleophilic and hydrophobic properties at the surface of the ink metering roller is vital, since lithography requires the presence of water in the films of ink being used. The presence of hydrophilic, or water attracting regions on the ink metering roller surface will allow water to displace or debond ink from those regions, thereby disrupting the roller's ink carrying and ink metering capabilities.

The above-named Fadner, et al, prior art references also teach that even when consistent ink metering is assured by providing a metering roller surface that is both hydrophobic and oleophilic, the water contents of the ink films on the inking rollers may vary across the press width, depending upon the relative amounts of ink and water consumed in satisfying the format being printed. To accomplish uniform ink availability across the press during a printing run, it is necessary to assure that a constant ink composition is continuously available to all portions of the printing plate. Unless constant ink composition is available across the press width, the water content tends to increase in regions of low print density and undesirable print quality occurs. Means for obtaining press wide uniformity of ink composition are disclosed in the Fadner, et al U.S. Pat. No. 4,690,055.

When hydrophilic regions are purposefully included in either a random or in geometrically uniform manner, such as the land areas of the celled metering roller disclosed in U.S. Pat. No. 4,637,310 by Sato and Harada or as in the non-celled or smooth-surfaced metering roller disclosed in U.S. Pat. No. 4,287,827 by Warner, it might be reasoned that predictability of ink metering will be achieved because any water interference due to debonding of ink from the hydrophilic regions would be in accord with the pattern selected when forming the hydrophilic regions. However, the through-puts of water and ink across the press width and therefore the relative amounts of each required, are determined by the image and non-image format on the printing plate being used at any given time. Printing formats are not uniform generally and are rarely the same from press-run to press-run. Consequently, the extent of ink debonding by water when operating an apparatus utilizing the oleophilic and hydrophilic technology will depend upon the instantaneous amounts of water present in the ink at various locations on the metering roller. These locations correspond in turn to the various cross-press ink and water amounts required to print the format on the printing plate. The higher the water content in the ink at a hydrophilic/region, the greater will be the propensity for loss of ink carrying capability because of debonding of ink in the corresponding localized region. The result is variable ink input from press-run to press-run as the printed format is changed, with concomitant printed regions of unexpectedly low or unexpectedly high optical density.

Hard ceramic materials, such as chromium and aluminum oxides and tungsten carbide are naturally high energy materials and correspondingly tend to be hydrophilic in the presence of water and tend to be oleophilic in the presence only of oily materials. Metering rollers manufactured using these materials, while often used successfully in conjunction with either water based inks or with oil based inks in letterpress printing, fail to deliver consistent quantities of ink during lithographic printing utilizing oil-based inks having water present. The extent of ink delivery inconsistency is determined by whether water present in the ink has displaced or debonded ink from the roller's ceramic surface. As previously noted, the extent of debonding depends upon the water content of the ink at any selected cross-press location, which water content in turn depends upon the format being printed.

The previously referred to Fadner U.S. Pat. No. 4,601,242 discloses one means to use the advantageously hard and wear-resistant ceramic property to obtain reasonably long lithographic ink metering roller lifetimes. Specifically, ceramic powder, and in particular alumina, is flame sprayed in a purposefully thin layer of less than about 2 mils thickness over a copper-plated metering roller base. Copper is naturally hydrophobic and oleophilic. This procedure results in a hard, wear-resistant surface that has sufficient inter-particle porosity relative to ink and water interactions that the surface acts as if it was copper, therefore retaining ink in preference to water, yet simultaneously acts as a wear-resistant ceramic material relative to scraping blade wearing action. Although commercially viable, this type of roll has a lifetime on a printing press of about 20 to 30 million printing impressions, because the ceramic layer must be kept relatively thin to assure that the oleophilic property of the underlying copper is not negated by the hydrophilic properties exhibited by the ceramic layer. Further, the ceramic layer, which is naturally hydrophilic, may become increasing hydrophilic due to accumulation of contaminants associated with use and cleaning of printing presses.

A primary object of this invention is to provide a simple, inexpensive ink metering roller that ensures long operational lifetimes in keyless lithographic printing press systems where the presence of water in the ink is involved.

An additional object of this invention is to provide a process for producing an ink metering roll having a microporous wear-resistant surface layer that is infused with a substantially organic material that reacts with the ceramic to form a reaction product surface layer that is oleophilic and hydrophobic.

Still another object of this invention is to provide means whereby hard and wear-resistant but naturally hydrophilic ceramic materials can be rendered hydrophobic and oleophilic without detracting from their naturally excellent wear-resistant quality.

A further object of this invention is to provide an improved inking roller having a composite structure that combines high degrees of wear resistance with a preferential attraction for and retention of oil inks in the presence of water.

Other objects and advantages of this invention will be in part obvious and in part explained by reference to the accompanying specification and drawing in which:

DESCRIPTION OF THE DRAWINGS

FIG. 1 is a schematic side elevation of keyless lithography printing system configuration illustrating a lithographic printing arrangement incorporating an ink metering roll of the present invention;

FIG. 2 is a sectional view through a portion of the roll of this invention showing the infused, wear resistant surface in which recesses to hold ink are provided;

FIG. 3 is a sectional view similar to FIG. 2 but with a roller having no individually formed ink receiving recesses;

SUMMARY OF THE INVENTION

Figure 4:
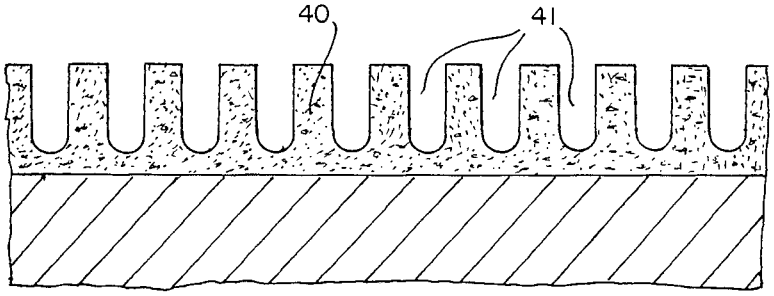
FIG. 4 is a sectional view similar to FIG. 3 showing a variation in the shape of individually formed ink receiving recesses.

This invention relates to an improved ink metering roll for metering ink in modern, high-speed lithographic printing press systems, and to an inking system wherein keyless means are provided to simplify the inking system and to simplify the degree of operator control or attention required during operation of the printing press.

Typically, a press using a keyless inking system will comprise an ink reservoir or sump 10, a pump 11 and piping 12 interconnecting an ink pan 13, within which a metering roller 13' is located, to supply ink to a frictionally driven ink transfer roller 15. A reverse angle scraping or metering blade 16 operates against the metering roller 13 to remove all of the ink on the metering roller 13 except that in cells or interstices, when present. Ink from transfer roller 15 is passed onto a substantially smooth inking drum 20 where it is combined with water supplied from dampener 21. Dampening fluid can be supplied by any appropriate means, either to the ink roll 20 as shown or directly to the plate roll 25, as indicated by the phantom lines at 26. The scraping blade 16 (or other ink removal means) operating against the metering roll 13' is present to continuously remove substantially all of the excess ink film therefrom. All of the aforesaid elements function to supply a uniform film of ink to the printing plate 28 mounted on press driven plate cylinder 25. The plate on cylinder 25 in turn supplies ink in the form of an image, for example, to a paper web 30 being fed through the printing nip formed by the coacting blanket cylinder 31 and impression cylinder 32. All of the rollers in FIGS. 1 and 2 are configured substantially axially parallel.

Many other press configurations can be visualized by those skilled in the art and science of keyless lithographic printing, the primary features that are important for proper operation of this invention are discussed below.

The amount of ink reaching the printing plate may be controlled by the dimensions of depressions or ink receiving cells formed in the surface of the ink metering roller in conjunction with a coextensive scraping or doctor blade that continuously removes virtually all of the ink from the celled metering roller except that carried in the cells or recesses.

The ink metering roller is composed of a steel or aluminum or comparable core material of suitable strength, length and diameter that is suitably coated with a relatively thick wear-resistant ceramic material. While the roller surface need not be engraved in all instances, laser engraving can be used to form accurately dimensioned and positioned cells or recesses, which cells together with a scraping doctor blade serve to precisely meter a required volume of ink. To ensure accurate and continuous metering of ink by all regions of the roller surface for the wear-related useful lifetime of the roller, the ceramic materials are infused with a material that reacts with the ceramic matrix to form a hydrophobic and oleophilic reaction product.

FIG. 2 is a cross-sectional view of one form of this invention in which the base roller used to produce metering roller 14 is engraved before application of the ceramic coating indicated by numeral 35.

The celled metering roller 13 illustrated in the drawings, may be, as previously mentioned, mechanically-engraved and then coated or may be first coated and then laser-engraved to form patterned cells of depressions in the coated surface of the roller. The volume and frequency of the depressions are selected based on the volume of ink required to meet the printed optical density specifications and in accordance with known practices. Alternatively, the roller may have a nominally smooth face with the hard, oleophilic and hydrophobic surface properties added as herein described.

Roller 13 is employed typically together with a scraping or doctoring blade 16 to meter the input of ink into the press system. Roller 20 may instead be employed as the metering roller to allow positioning the metering roller closer to the printing plate and in that case function together with a scraping blade, as like 16 shown at roller 13' to remove from the printing system virtually all of used return ink that exists at that location. Rollers 14 and 15 are then not needed. Rollers 13' and 15 are then not needed. In either case the return film of ink, that is the unused portion of the input ink, is continuously scrapted off and led to sump 10 for subsequent continuous recirculation by pump 11 back to the celled metering roller 13' or 20. Many of these keyless lithography press operational elements are described in more detail in Fadner, et al U.S. Pat. No. 4,690,055.

I have found that the commonly available hard, wear-resistant ceramic and ceramic-like materials such as alumina, tungsten carbide or chromium oxide, all of which are available for manufacture of an inking roller, prefer to have a layer of water rather than a layer of oil-based ink on their surfaces when both liquids are present. Although various ceramic materials are known to function as the hard, wear-resistant uppermost surface of ink metering rollers either for a printing system such as letterpress involving a single oil-based printing fluid or for flexographic printing systems using a single water-based inking fluid, these same ceramic surfaces when used in lithographic printing will become debonded of an oil or resin-based ink whenever sufficient dampening water penetrates through the ink to the roller. This is more readily understood if one considers that hydrophilic or water-loving surfaces such as ceramic materials are, in the absence of water, oleophilic or oil loving. When fresh, unused, water-free lithographic ink is applied to a ceramic, the ink initially exhibits good adhesion to and wetting of the roller surface. Under these initial conditions, normal ink-metering performance is observed. However, during lithographic printing operations, as the water content in the ink increases, a condition is reached where a combination of roller nip pressure and increasing water content in the ink force water through the ink layer to the ceramic metering roller surface. By adhering preferentially to the roller's surface, the water debonds the ink from that surface, thereby disallowing subsequent pickup of ink from the ink input means.

I have found that water-interference problems associated with using state-of-the-art ceramic-covered rollers to meter ink in keyless lithographic inking system can be avoided by fixedly applying to the ceramic roller's surface and infusing into the interstices of a microporous layer of ceramic material a material that reacts with the ceramic to form a reaction product that possesses oleophilic and hydrophobic properties. Ceramic rollers thus treated function as metering rollers in lithographic printing systems without the aforementioned chemically-related ink metering failure.

In one form of this invention a steel or aluminum or other suitable roller may be mechanically engraved in patterns similar for instance to those shown in FIG. 2, then flame-spray ceramic coated to the maximum thickness that substantially retains the cell structure originally present in the core's surface, about 5 to 8 mils. The deposition process normally requires repeated thin-application passes of the ceramic coating apparatus, and may be followed by infusion with a selected organic substance, as elsewhere described herein. In the case of a base roller manufactured of aluminum, the roller can be given a hard anodizing treatment to form the ceramic-like layer in situ.

Alternatively, the roller core is similarly mechanically engraved, then one-pass flame-spray coated with a thin film of ceramic powder to a coating thickness typically less than about 0.1 to 0.2 mil, then infused with the material that reacts with the ceramic to form the oleophilic and hydrophobic substance, then given another ceramic coating pass, then another infusion treatment and so on until the desired 5 to 8 mil thick ceramic coating is built-up by successive coating and infusion treatments.

Figure 5:
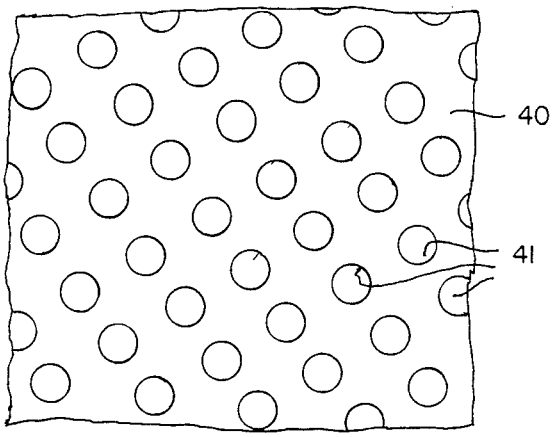
FIG. 5 is a plan view of FIG. 4.

The desired microporous layer can be obtained also by subjecting a steel or aluminum roller core to a multiple-pass flame-spray coating with the selected ceramic particles to build up a thick, from 3 to about 10 mil or more coating. This coating, such as indicated by numeral 40 in FIGS. 4 and 5, is then laser engraved to create cell patterns 41 for instance as depicted in FIGS. 4 and 5, after which the reactive agent is infused into the ceramic surface.

The same sort of structure can be obtained where the reactive agent is applied after each flame-spray coating pass in a series of about 6 to 20 or so sequences, to achieve the desired oleophilic and hydrophobic ceramic coating thickness, then laser engraved to create the required ink carrying capacity.

Several types of agents reactive with the ceramic can be used. Reactive agents are here meant to mean those organic substances that can be infused into and react with and thereby become chemically attached to the microporous ceramic to form a reaction product that has oleophilic and hydrophobic properties. These are generally dissolvable solids or liquids that can therefore be applied by mist, spray, dip or other well known application methods. One primary objective in applying the reactive agent is to render as much as possible of the microporous ceramic powder coating surfaces oleophilic and hydrophobic by penetration of the hydrophobe as deep into the coating as possible. Highly mobile liquid systems are preferred. Simple spray-painting techniques are appropriate as are dip-coating with roller rotation. Dilute solutions of the reactive agent in solvents that allow seconds to minutes open-time will help to provide penetration deep into the interstices of the ceramic coating.

In all cases, the ultimate oleophilic and hydrophobic reaction product must be rendered essentially immobile and firmly adhered to or entrapped within the ceramic powder coating's voids and surfaces. The objects of this invention are achieved through the infusion of materials that are chemically reactive with high energy surfaces to form hydrophobic and oleophilic films. Generally, these will be long chain hydrocarbons or substantially hydrocarbon polymeric materials having chemically reactive groups incorporated thereto. Materials which fulfill the requirements are those selected from the group consisting of titanate coupling agents marketed by Kenrich Petrochemicals of Bayonne, N.J. and silane agents marketed by Lord Chemical Co. of Erie, PA. Other useful agents of this class will be apparent to those skilled in the chemical and polymeric sciences and based on the elements of this invention herein disclosed. Effective titanate coupling agents are: isopropyl, tri (dioctylpyrophosphato) titanate; titanium di (octylpyrophosphato) oxyacetate; isopropyl, triisosteroyl titanate; tetra diallyloxy-methyl 1-1 butoxy titanium di (ditridecyl) phosphite; and di (dioctylphosphato) ethylene titanate. Effective silane coupling agents are isobutyltrimethoxysilane and n-octyltriethoxysilane.

Figure 6:
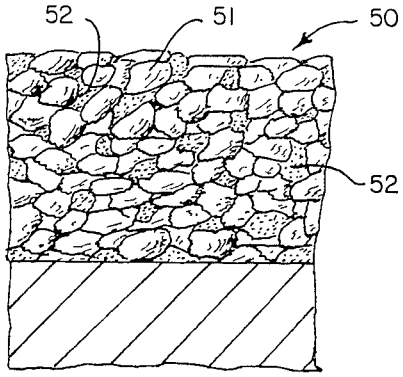
FIG. 6 is an enlarged illustration of a section through the microporous ceramic layer to show the location of the oleophilic and hydrophobic reaction product.

FIG. 6 of the drawings illustrates the manner in which the reactive agent is infused into the interstitial voids formed by the ceramic coating. In FIG. 6, numeral 50 indicates generally the composite wear resistant layer, while numeral 51 identifies the particles of ceramic material and numeral 52 the infused substance which reacts with particles 51 to form the required oleophilic and hydrophobic reaction product. For a maximum useful life it is preferred that the entire interconnecting network of voids formed by the deposited ceramic layer be infused substantially completely throughout the volume of the layer.

Notwithstanding certain general or specific material disclosures of agents that are suitable to the practice of this invention, the important criterion for the resulting roller's use as a lithographic inking roller can be more-or-less predicted by measuring the degree to which droplets of ink oil and of water will spontaneously spread out on the surface of the treated roller. The sessile drop technique as described in standard surface chemistry textbooks is suitable for measuring this quality. Generally, oleophilic and hydrophobic roller materials will have an ink oil (Flint Ink Co.) contact angle of nearly 0° and a distilled water contact angle of about 90° or higher and these values serve to define an oleophilic and hydrophobic material.

I have found, for instance, that the following rules are constructive in but not restrictive for selecting materials according to this principle:

| | |
|---|---|
| Best | Water contact angle 90° or higher.<br>Ink Oil contact angle 10° or lower and spreading. |
| Maybe | Water contact angle 80° or higher. |

-continued

| | |
|---|---|
| Acceptable | Ink Oil contact angle 10° or lower and spreading. |
| Probably Not | Water contact angle less than about 80° |
| Acceptable | Ink Oil contact angle greater than 10° and/or non-spreading. |

Materials that have this oleophilic and hydrophobic property as defined herein will in practice in a lithographic printing press configuration accept, retain and maintain lithographic ink on their surface in preference to water or dampening solution when both ink and water are presented to or forced onto that surface. And it is this combined oleophilic and hydrophobic property that allows rollers used in lithographic press inking roller trains to assist in the transport of ink from an ink reservoir to the substrate being printed without loss of printed-ink density control due to debonding of the ink by water from one or more of the inking rollers.

We claim:

1. A wear-resistant ink metering roller possessing oleophilic and hydrophobic properties comprising:

a. a base roller of preselected strength, diameter and length having an outer surface of substantially cylindrical shape:

b. a substantially continuous microporous ceramic layer integral to the outer surface of said base roller, said microporous ceramic layer defining an interconnecting network of openings that permeate substantially the entire volume of said ceramic layer; and c. a material infused with said ceramic layer which produces an oleophilic and hydrophobic reaction product of said microporous ceramic layer with said material, said material selected from the group consisting of a titanate coupling agent and a silane coupling agent.

2. An ink metering roller as defined in claim 1 wherein said titanate coupling agent is selected from the group consisting of:

a. isopropyl, tri (dioctylpyrophato) titanate;

b. titanium di (octylpyrophosphato) oxyacetate;

c. isopropyl, triisosteroyl titanate;

d. tetra diallyloxy-methyl 1-1 butoxy titanium di (ditridecyl) phosphite; and e. di (dioctylphosphato) ethylene titanate.

3. An ink metering roller as defined in claim 1 wherein said silane coupling agent is selected from the group consisting of: (a) isobutyltrimethoxysilane and; (b) n-octyltriethoxysilane.

4. An ink metering roller as defined in claim 1 wherein said microporous ceramic layer is from about 3 to 8 mils thick.

5. In a process for producing a wear resistant ink metering roller possessing oleophilic and hydrophobic properties the steps comprising:

a. providing a roll having a substantially cylindrical surface layer formed of a microporous ceramic material which defines an interconnecting network of openings that permeate substantially the entire volume of the microporous layer; and b. infusing the interconnecting network with an organic material selected from the group consisting of a titanate coupling agent and a silane coupling agent in a preselected solvent to combine with the ceramic and form a reaction product possessing oleophilic and hydrophobic properties.

6. A process as defined in claim 5 wherein the microporous ceramic layer is deposited on the base roll in incremental applications and wherein each incremental layer is infused prior to deposition of the next incremental part of the ceramic layer.

7. A keyless lithographic printing press system utilizing at least an oil based ink comprising:

a. a base roller of preselected strength, diameter and length having an outer surface of substantially cylindrical shape;

b. a substantially continuous microporous ceramic layer integral to the outer surface of said base roller, said microporous ceramic layer defining an interconnecting network of openings that permeate substantially the entire volume of said ceramic layer; and c. a material infused with said ceramic layer which produces an oleophilic and hydrophobic reaction product of said microporous ceramic layer with said material, said material selected from the group consisting of a titanate coupling agent and a silane coupling agent; and d. scraper means mounted in reverse-angle relationship contact with said infused microporous ceramic coated base roller to remove at least excess ink therefrom, said infused microporous ceramic coated base roller being an ink metering roller in the keyless lithographic printing press system.

8. An ink metering roller as defined in claim 7 wherein said titanate coupling agent is isopropyl, tri (dioctylpyrophato) titanate.

9. An ink metering roller as defined in claim 7 wherein said titanate coupling agent is titanium di (octylpyrophosphato) oxyacetate.

10. An ink metering roller as defined in claim 7 wherein said titanate coupling agent is isopropyl, triisosteroyl titanate.

11. An ink metering roller as defined in claim 7 wherein said titanate coupling agent is tetra diallyloxymethyl 1-1 butoxy titanium di (ditridecyl) phosphite.

12. An ink metering roller as defined in claim 7 wherein said titanate coupling agent is di (dioctylphosphato) ethylene titanate.

13. An ink metering roller as defined in claim 7 wherein said titanate coupling agent is isobutyltrimethoxysilane.

14. An ink metering roller as defined in claim 7 wherein said titanate coupling agent is n-octyltriethoxysilane.

15. An ink metering roller as defined in claim 7 wherein said silane coupling agent is isobutyltrimethoxysilane.

16. An ink metering roller as defined in claim 7 wherein said silane coupling agent is n-octyltriethoxysilane.

* * * * *